US005697768A

United States Patent [19]

Mills

[11] Patent Number: 5,697,768

[45] Date of Patent: Dec. 16, 1997

[54] DOWNHOLE SWIVEL

[75] Inventor: Robert A. R. Mills, Bragg Creek, Canada

[73] Assignee: Kuda Industries, Inc., Canada

[21] Appl. No.: 609,727

[22] Filed: Mar. 1, 1996

[51] Int. Cl.[6] ..... F04C 2/107; F04C 15/00

[52] U.S. Cl. ..... 417/365; 417/448; 166/117.7; 166/68.5; 464/178; 464/179

[58] Field of Search ..... 417/365, 448, 417/449, 450; 166/370, 117.7, 68.5; 464/18, 178, 179, 183, 185; 418/48

[56] References Cited

U.S. PATENT DOCUMENTS

| | | | |
|---|---|---|---|
| 4,030,546 | 6/1977 | Rogers | 166/208 |
| 4,669,961 | 6/1987 | Lorett | 417/365 |
| 5,139,090 | 8/1992 | Land | 166/369 |
| 5,417,281 | 5/1995 | Wood | 166/68 |
| 5,431,230 | 7/1995 | Land | 166/369 |
| 5,549,465 | 8/1996 | Varadan | 418/48 |

FOREIGN PATENT DOCUMENTS

| | | | |
|---|---|---|---|
| 540007 | 4/1957 | Canada . | |
| 924181 | 4/1973 | Canada | 103/18 |
| 1057120 | 6/1979 | Canada | 103/20 |

*Primary Examiner*—Charles G. Freay
*Attorney, Agent, or Firm*—Stein, Pendorf & Van Der Wall

[57] ABSTRACT

A method and apparatus is disclosed which reduces or removes axial loads on the drive string of a rotary downhole pump, i.e. tensile loads due to the hydrostatic load of the pumped liquid on the pump rotor, and/or at least part of the weight of the drive string, or thrust loads caused during pressurized fluid injection operations by backpressure of injected fluid on the pump rotor. This substantially prevents drive string/production tubing friction, wear and/or buckle in downhole rotary pumping arrangements operated in straight or curved well bores. When used in connection with fluid production pumping arrangements, the apparatus reduces the friction between the drive string and the production tubing of a downhole rotary pump for the pumping of well fluids which pump has a pump rotor connected to the drive string and is operated in a well bore. When used in connection with fluid injection pumping arrangements, the apparatus prevents drive string buckle, especially in curved well bore situations. The apparatus includes a support for rotatably supporting the drive string in the production tubing at a location above the pump, and a fluid passage for permitting the pumped fluid to flow from the pump to a wellhead of the well. The support includes an axial load bearing structure for supporting, from the production tubing, at least part of an axial load on the drive string either generated by the hydrostatic load of a pumped liquid on the pump rotor or backpressure of injected fluid on the pump rotor. The fluid passage is shaped and constructed such that the pumped fluid can flow from the pump past the axial load bearing means to the wellhead. In fluid pumping applications, the apparatus can also be used to support at least part of the weight of the drive string to reduce the axial load on the drivehead.

17 Claims, 3 Drawing Sheets

DOWNHOLE SWIVEL

FIELD OF THE INVENTION

The invention relates to downhole rotary pumping systems. More particularly, the inventions relates to a swivel arrangement for supporting from the production tubing at least part of an axial load on the drive string of a rotary downhole pump. The axial load may be due to the hydraulic load of the pumped liquids on the pump rotor and/or at least part of the weight of the drive string or due to fluid backpressure on the pump rotor when the pump is used for high pressure fluid injection applications.

BACKGROUND OF THE INVENTION

Downhole rotary pumps are generally driven by a sucker rod string which extends through and rotates in a concentrically arranged production tubing string. Other types of solid drive strings or tubular drive strings may be used to drive the pump, but the forces on the drive string and tubing are similar. Upon actuation of the pump by rotation of the drive string, the pumped fluids are forced to the ground surface through the annular space provided between the drive string and the production tubing. The drive string is made up of a plurality of rods or tubes which are connected together end to end. Each rod or tube typically has enlarged diameter threaded pin ends. For example, sucker rod couplings which have a larger diameter than the stem and complementary internally threaded ends are respectively used to connect adjacent sucker rods. Rotary downhole pumps generally include a stator affixed to the production tubing and a rotor connected to and supported by the drive string.

Submersible rotary pumps such as progressing cavity pumps were originally used in shallow well applications but recently have found application in deep well pumping systems for the pumping of heavy crude laden with sand. They are now commonly used in wells that vary from 1,500 to 6,000 feet in depth, and produce heavy, medium and light crude oil. The resulting large weight of the column of pumped liquids, the hydrostatic load which rests on the rotor of the pump and, thus, must be supported by the drive string, along with the weight of the drive string, exerts considerable strain on the drive string. This is especially apparent in horizontal or directional wells where the tensile stress in the drive string results in a radial force between the drive string and the production tubing string around the bends in the well.

The more thorough exploitation of oil reservoirs today often involves close spacing of the wells and drilling of a number of directional or horizontal wells from a common site. The production tubing and drive strings in such wells tend to assume a curvilinear configuration. When the diameter of the bend is sufficiently large for the installation of the production tubing, the pump, and the drive string, submersible downhole pumps can be employed. However, the curvature of the production tubing and the tension in the drive string, caused by the string's own weight and by the supported hydraulic load, causes a high side loading between the drive string and the production tubing around the bends. The side load causes the drive string and especially the couplings to lie against the inside of the production tubing and which results in severe damage to the production tubing when the drive string is rotated and the couplings rub against the tubing wall.

In order to prevent such damage, centralizing sucker rod couplings such as disclosed in U.S. Pat. No. 4,757,861 of Klyne are commonly employed. These centralizer couplings include a shaft connected between adjacent sucker rods and rotatable in a centralizer sleeve. The centralizer sleeve has outer vertical ribs to allow passage of the pumped fluids between the sleeve and the tubing. The centralizers are quite effective at preventing rod and tubing wear and have a suitably long service life if not overloaded. However, in short radius horizontal wells with severe bends, for example, it is necessary to run a large number of short rods, so called pony rods, to increase the number of centralizers and reduce the side load per centralizer to an acceptable level which ensures a sufficiently long service life. This arrangement then becomes costly and uneconomical because of the large number of pony rods and centralizers required.

Although this problem could be reduced by simply producing a larger radius bend when drilling the well, this solution is not acceptable to well operators especially with horizontal wells. There are three reasons why an operator may wish to make a window in a well casing and drill a short radius bend to the horizontal:

1. The shallower formations are unstable and unsuitable for making a deviated hole;

2. The reservoir is faulted and the risk of missing it with the horizontal section increases with distance from the well; and 3. The cost will be lower with a short radius.

Thus, a means is desired which would reduce the axial tension on the drive string and allow the use of submersible rotary pumps in deviated wells, especially horizontal wells and reduce the number of pony rods and centralizers required.

Recently progressing cavity pumps have been employed not only for the production of fluids from a well but also for the injection of fluids into the well and under elevated pressure to stimulate the well and increase production. This is advantageous, since the pump rotor and drive string combination need no longer be pulled up for the well stimulation operations. However, use of a progressing cavity pump for fluid injection during well stimulation may result in serious damage to the drive string at elevated pressures. The pump rotor of a progressing cavity pump is supported from the pump drivehead by way of the drive string and is not mounted in any way to the pump stator. Thus, any axial load on the rotor directly translates into a corresponding axial load on the drive string. In high pressure fluid injection applications, the backpressure of the injected fluid may place such strain on the rotor/drive string combination that the drive string will buckle under the axial load leading to permanent damage to at least the drive string but likely to other components of the rotary pumping setup as well, for example the pump rotor and stator and the production tubing. Thus, a means is desired which would reduce the axial thrust forces on the drive string in high pressure fluid injection applications. More particularly, a means is desired which would allow not only the supporting of axial tension but also axial thrust forces on the drive string, i.e. axial loads in general, to permit use of a progressing cavity pump for both fluid production and fluid injection applications.

SUMMARY OF THE INVENTION

It is now an object of the present invention to provide a method and apparatus for a rotary downhole pumping arrangement which prevents damage and/or wear of one or more components of the pumping arrangement upon axial loads on the pump rotor.

It is a further object of the present invention to provide a method and apparatus which reduces drive string/production tubing friction and wear in downhole rotary pumping arrangements operated in bores having at least one curved section.

In a particular aspect, the invention provides a downhole apparatus for reducing or removing the tensile load on the drive string of a rotary downhole pump due to the hydrostatic load on the pump rotor, and/or at least part of the weight of the drive string.

It is yet a further object of the invention to provide a method and apparatus for preventing buckling of the drive string upon use of a downhole rotary pumping arrangement for high pressure fluid injection into the well.

It is another specific object of the invention to provide a downhole swivel arrangement for supporting from the production tubing string instead of the drive string at least part of the hydrostatic load on the pump rotor of a downhole rotary pump and/or the weight of the drive string.

It is yet a further object of the invention to provide a pumping system for a well bore having at least one curved section which system includes a downhole rotary pump driven by a drive string extending through a production tubing string and at least one swivel arrangement for supporting from the production tubing at least part of the hydrostatic load on the pump rotor and at least part of the weight of the drive string.

In yet another aspect, the invention provides a downhole swivel arrangement for supporting on the production tubing at least part of an axial thrust load on the pump rotor due to backpressure of the injected fluid during fluid injection operations.

There is provided in accordance with the invention a downhole apparatus for use in a downhole rotary pumping arrangement which includes a downhole rotary pump for the pumping of well fluids, the pump having a pump rotor connected to and operated by a pump drive string rotatable in a production tubing and suspended from a drivehead. The apparatus is used for supporting on the production tubing at least part of an axial load on the drive string either in the form of axial tension caused by hydrostatic load of the pumped fluid on the rotor or in the form of axial thrust caused by backpressure on the rotor of fluid injected into the well by way of the pump. The apparatus includes, a support for rotatably supporting the drive string in the production tubing at a location between the pump rotor and the drivehead, the support having an axial load bearing means for supporting, on the production tubing, at least part of an axial load on the drive string caused by an axial load on the pump rotor, and/or at least part of the weight of the drive string; and a fluid passage for permitting the pumped fluid to flow from the pump past the axial load bearing means to a wellhead of the well.

In a preferred embodiment, the support has a cylindrical housing for connection to the production tubing and a hollow shaft or quill for connection to the drive string, the quill being axially rotatably supported in the housing by an intermediate radial bearing, and the load bearing means includes an annular bearing seat on and radially inwardly protruding from the housing, an opposingly positioned radially inwardly protruding load bearing flange on the quill, and a thrust bearing positioned therebetween. Most preferably, the load bearing means includes a pair of thrust bearings adapted to support axial thrust loads and axial tension loads respectively, each bearing being held in position between an associated bearing seat on the housing and a load bearing flange on the quill. The radial bearing is preferably a needle bearing and the thrust bearing is preferably a spherical roller thrust bearing.

It is preferred that the fluid passage be provided by the interior of the quill and by a pair of fluid cross-over means for respectively connecting, at an end of the quill, the interior of the quill with the adjacent annular space between the production tubing and the drive string. The cross-over means is preferably a cross-over member which includes a solid shaft having an enlarged end, connecting means for coaxially attaching the enlarged end to one of the ends of the inner quill, an axial bore in the enlarged end, and at least one radial bore in the shaft located behind the connecting means and communicating with the axial bore. The radial bore is preferably an oblique radial bore which encloses an acute angle with an axis of the shaft. The cross-over member preferably includes four oblique radial bores which are evenly distributed about the axis of the shaft and penetrate an outer surface of the shaft behind the enlarged portion. The cross-over preferably includes at least two radial bores which are preferably sized and positioned such that the sum of the cross-sectional areas of the radial bores equals or exceeds the cross-sectional area of the axial bore to minimize frictional resistance to flow, while not creating a weak point in torsion or tension. The cross-sectional area of the steel at any point through the oblique radial bores preferably equals or exceeds the cross-sectional areas of the threaded pin and socket ends, and the torsional strength equals or exceeds that of the threaded pin.

BRIEF DESCRIPTION OF THE DRAWINGS

The invention will now be further described by way of example only and with reference to the attached drawings, wherein.

DETAILED DESCRIPTION OF THE PREFERRED EMBODIMENTS

Although the apparatus of the present invention will be discussed in detail with reference to a fluid production application in a curved well bore, the apparatus can be employed equally well in straight and curved/angled well bores and can be used in fluid production as well as fluid injection applications of the pumping arrangement.

Figure 1:
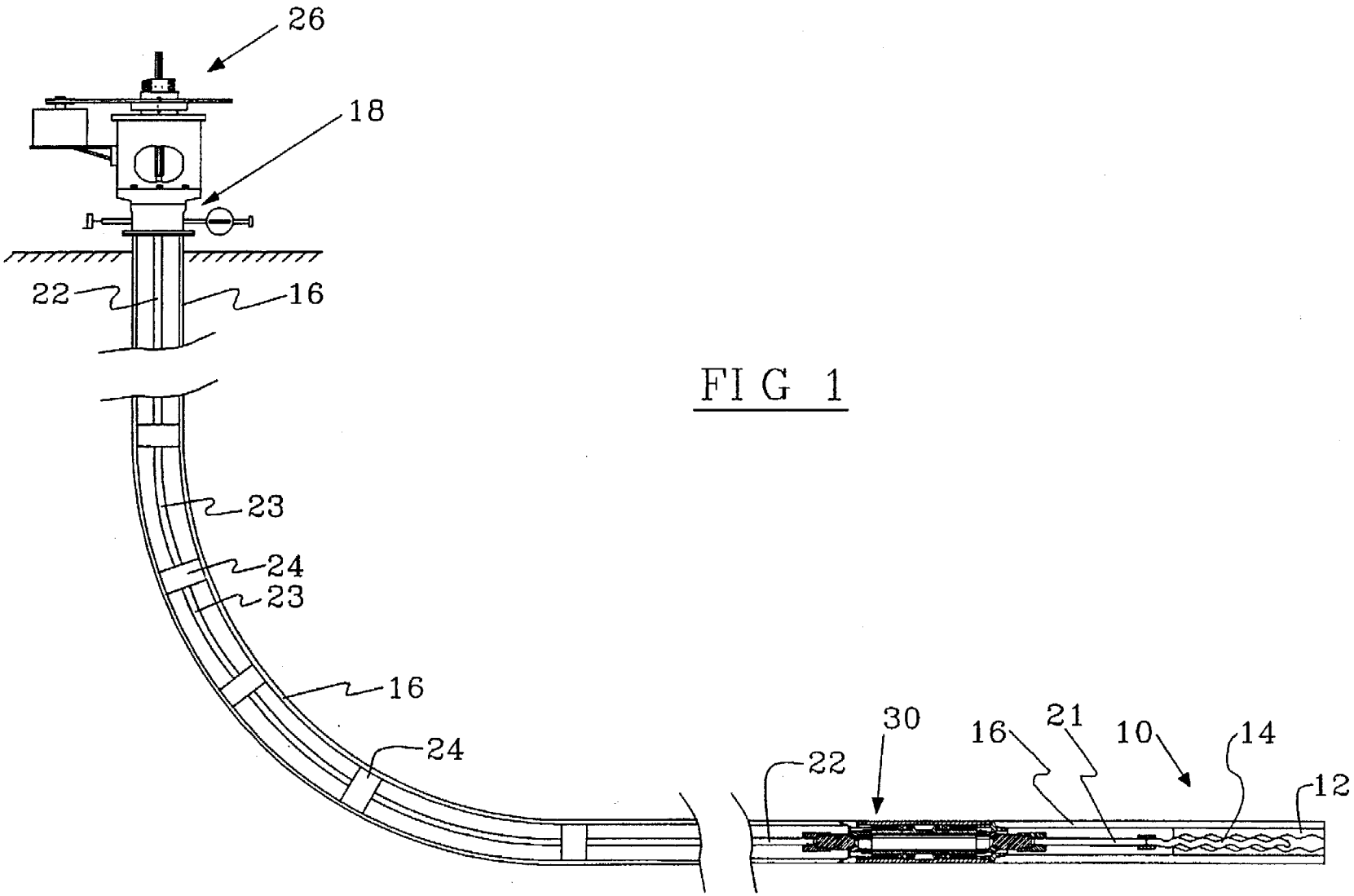
FIG. 1 is a schematic illustration of a downhole rotary pump system including a downhole swivel arrangement in accordance with the invention.

A downhole rotary pumping system for a well having at least one curved section, such as a horizontal well as illustrated in FIG. 1 includes a downhole rotary pump 10, in this embodiment a Moineau pump including a pump stator 12 and a pump rotor 14. The pump stator 12 is suspended from and affixed to a production tubing 16 which extends from a wellhead 18 down the well bore. The pump rotor on the other hand is suspended from and affixed to the bottom end of a sucker rod string 22 which extends through the production tubing 16 and the wellhead 18. The sucker rod string is constructed of a plurality of sucker rods 23 which are interconnected by rod couplings 24 that also centralize the rod string in the production tubing. The rod string and the tubing follow the curved well bore. The rod string is rotated by way of a drive head 26 mounted to the wellhead, usually incorporating an electric motor, pulleys and V-belt combination. In the pumping system shown, a swivel arrangement 30 in accordance with the invention is integrated into the production tubing 16 close to the pump 10 and between the curved section of the rod and tubing strings and the pump. The swivel arrangement 30 will be described in more detail with reference to FIG. 2.

Figure 2:
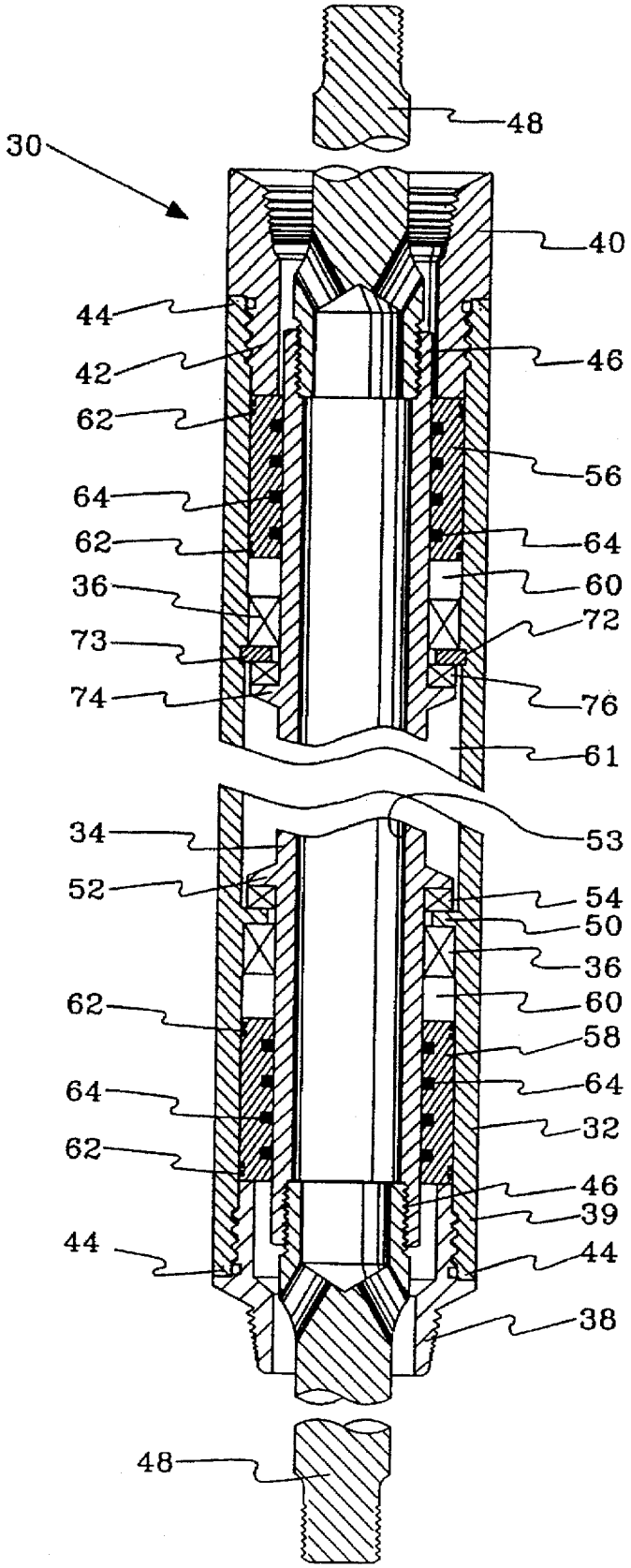
FIG. 2 is an axial cross-section through a downhole swivel arrangement in accordance with the invention.

The swivel arrangement 30 in accordance with the invention illustrated in FIG. 2 includes a sleeve or housing 32 and a hollow shaft or quill 34 which is rotatably supported in the housing by a pair of radial bearings 36 (for example, Torrington WJ-344024 radial needle roller bearings; dynamic load capacity 15,700 lbs). An API pin thread stub 38 (3¼"-8 stub Acme) is screwed into the lower end 39 of the housing 32 and an API box thread stub 40 is screwed into the upper end 42 of the housing for attachment of the housing ends to, and incorporation of the housing into the production tubing 16 (see FIG. 1). Disengagement of the stubs 38, 40 from the housing 32 is prevented by set screws 44. The quill is at each end provided with a box thread 46 (such as, 10 thds/inc, ¾" taper/ft) for respective engagement of one of a pair of cross-overs 48 which will be described in further detail below. In the pumping system illustrated in FIG. 1, the quill/cross-over combination of the swivel arrangement is incorporated into the sucker rod string 22. The housing 32 includes a radially inwardly protruding annular bearing seat 50. A radially outwardly projecting load bearing flange 52 is provided on the quill 34. The axial position of bearing seat 50 and load bearing flange 52 is respectively selected such that when the quill is fully inserted into the housing, the axial distance between seat 50 and flange 52 corresponds to the axial length of a thrust bearing 54 placed therebetween. A spherical roller thrust bearing is preferred for maximum load bearing capacity in the limited radial space available. Thus, the quill 34 is rotatably supported in axial direction in the housing 32 by the combination of seat 50, flange 52 and intermediate thrust bearing 54. Moreover, when the swivel arrangement 30 in accordance with the invention is used in a horizontal well application as shown in FIG. 1 by attachment of the housing and the quill to the tubing 16 and the sucker rod string 22 respectively, the downwardly directed axial load on the pump rotor due to the hydrostatic load of the pumped liquid, which load normally would be supported by the rod string, is supported by the tubing instead. This results in a substantially decreased tension in the rod string and significantly reduced wear of the rod string and the tubing in the curved sections of the well bore. If the curved section is higher in the well, the swivel would be placed immediately below such curved section and it would support the weight of that portion of the drive string below it as well as the hydrostatic load on the rotor.

The overall construction of the swivel arrangement 30 and especially the axial load bearing parts thereof allows the use of the swivel arrangement for the transfer of any axial load on the pump rotor 14, be it a tension load or a thrust load, onto the production tubing. Thus, the swivel arrangement is universally useable in fluid production and fluid injection applications.

Upper and lower seal retainer sleeves 56, 58 are positioned between the housing 32 and quill 34 at the respective upper and lower ends thereof to seal the radial bearings 36 and thrust bearings 54, 76 from the pumped fluids and particulate materials suspended therein. The seal retainer sleeves are provided with internal seal seats (for example, for 25002/25N4263A90 Polypacks™) and external "O"-ring grooves (233-8309 "O"-rings) 62. The chambers 60 between the seal retainer sleeves and the bearings, and the chamber 61 between the bearings are filled with lubricant. The seal sleeves are free to move axially and thus balance the internal pressure of the lubricant with the hydrostatic pressure.

The inner surfaces of the seal retainer sleeves are in close proximity to the opposing surfaces of the quill to aid in sealing and to exclude particulate materials suspended in the pumped fluids. Therefore, they are preferably made of wear resistant materials to resist abrasion, and are preferably of dissimilar materials to make compatible bearing surfaces. If the materials are properly chosen, radial bearings 36 can be omitted. The preferred embodiment includes grey cast iron seal retainer sleeves and a chrome-plated quill.

Figure 3:
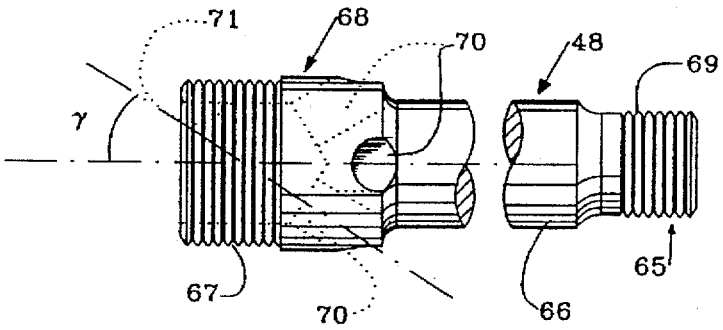
FIG. 3 is a side elevation of one of the cross-over portions of the swivel arrangement shown in FIG. 2.
Figure 4:
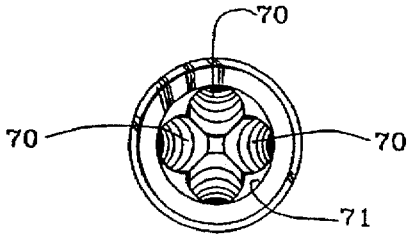
FIG. 4 is an end view of the cross-over portion shown in FIG. 3 as seen from the enlarged end.
Figure 5:
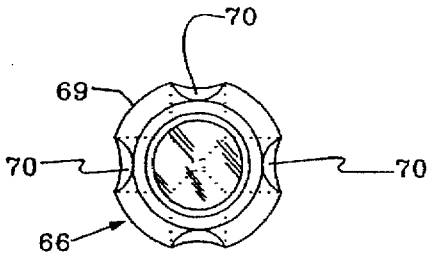
FIG. 5 is an end view of the cross-over portion shown in FIG. 3 as seen from the end adjacent the rod string in use.

When the swivel arrangement is installed in a rotary pumping system, the bearings 36 and 54 partially obstruct, and the seal retainer sleeves 56, 58 and the seals 62, 64 block the annular space between the rod string 22 and the tubing 16 (see FIG. 1) through which the fluids are normally conveyed. Therefore, in order to permit pumping of the well fluids, the swivel arrangement is provided with a fluid passage through which the well fluids can flow from the pump, past the bearings 36, 54, the seal retainer sleeves 56, 58, and the seals 62, 64, to the wellhead 18 (see FIG. 1). In the illustrated embodiment, this passage is provided by a combination of the hollow interior 53 of the quill with the cross-overs 48 which will be discussed in detail in the following with reference to FIGS. 3–5. Each cross-over is made of a solid shaft 66 which has one enlarged end 68 of increased diameter. At each end, the cross-over is provided with external threaded portions 67 or 69 for attachment to the quill 34 (see FIG. 2) and a drive rod 23 (see FIG. 1) respectively. In the installed condition of the swivel arrangement in accordance with the invention, the preferred arrangement is that the enlarged end 68 of each cross-over is attached to the quill 34 and the opposite end 65 is attached to a drive rod 23 (see FIG. 1) by way of a threaded portion 69. The cross-over 48 located on the end towards the pump, is attached to a connecting rod 21 which is of sufficient length and flexibility to accommodate the eccentric motion of the rotor. The enlarged end 68 is provided with an axial bore 71 which is coaxial with the shaft 66 and with the quill 34 in the installed condition. Four oblique radial bores 70 are provided in the shaft at the enlarged end 68 and behind the externally threaded portion 67. The bores 70 are evenly spaced about the circumference of the shaft 66, each communicate with the axial bore 71 and each enclose an acute angle $\gamma$ with the axis of the shaft, in this embodiment an angle of 30°. Although each cross-over preferably includes four oblique bores, any number of bores can be used as long as the structural integrity of the cross-over is not compromised and a sufficient fluid flow through the swivel arrangement is achievable. In the preferred embodiment, the dimensions of the radial bores 70 are selected such that the sum of the cross-sectional areas of the radial bores equals or exceeds the cross-sectional area of the axial bore 71 to minimize frictional resistance to flow while not creating a weak point in the cross-over subject to damage upon high torsion or tension loads. The cross-section of the steel at any point through the radial bores in this embodiment equals or exceeds the cross-sectional areas of the threaded pin and socket ends, and the torsional strength equals or exceeds that of the threaded pin.

In the installed condition of a swivel arrangement in accordance with the invention and during fluid production operations, well fluids conveyed by the pump 10 (see FIG.

1) flow upward from the pump in the annular space between the rod string 22 and the tubing 16 until they reach the lower end of the swivel arrangement 30. There the pumped fluids pass through the oblique bores 70 of the lower cross-over 48 into the axial bore 71 and the interior of the quill 34, and through the axial bore 71 and the oblique bores 70 of the upper cross-over 48 back out into the annular space between the rod string and the tubing. Thus, the combination of the cross-overs 48 and the hollow quill provide an axial fluid passage past the bearings 36, 54, the seal retainer sleeves 56, 58 and the seals 62, 64 so that the well fluids can be conveyed from the downhole pump to the wellhead 18 (see FIG. 1).

In the most preferred embodiment illustrated in FIG. 2, the housing 32 and the quill 34 of the swivel arrangement 30 respectively include a second bearing seat 72 and a second load bearing flange 74, as well as a second thrust bearing 76 therebetween. The second bearing seat 72 is provided by a snap ring fittingly received in a complementary snap ring groove 73 in the interior surface of the housing. The snap ring groove 73 and the second flange 74 are positioned in relation to the second thrust beating 76 such that a small amount of tension can be introduced into the rod string 22 to prevent buckling of the rod(s) 23 located above the swivel arrangement 30. At the same time, the second thrust bearing also ensures that the swivel arrangement 30 is universally useable for both fluid production and fluid injection operations, whereby in the first case the hydrostatic load of the pumped fluid is supported on one of the first and second thrust bearings and in the second case, the axial thrust due to backpressure of the injected liquid is supported on the other of the thrust bearings.

Although in the embodiment of FIG. 2 the cross-overs 48 are shown as individual parts which are attached to the quill 34, one or both of them can readily be incorporated into the quill. Nevertheless, it is preferred that the cross-overs 48 be removably attached to the quill 34 for ease of assembly and installation. Furthermore, although the angle between the oblique bores 70 and the axis of the cross-over 48 is preferably 30°, larger angles up to 90° and angles smaller than 30° can also be used as long as the desired fluid flow through the cross-over is still achievable.

The swivel arrangement 30 is preferably installed far enough from the downhole pump that the eccentric motion of the rotor will not place undue stress upon the connecting rod(s) 21 and the swivel. For fluid production applications, the swivel arrangement 30 can be placed at any location between the wellhead and the pump or in horizontal well applications, between the curved section of the well bore and the pump without seriously impeding the pump's function. In other words, the friction between the rod string and the tubing can be reduced by placement of a swivel arrangement in accordance with the invention between the pump and the curved section of the well bore. However, for fluid injection applications the swivel arrangement 30 is preferably positioned directly adjacent the connecting rod 21 to minimize the possiblity of drive string buckle. Thus, when the downhole rotary pumping arrangement is to be used for fluid production as well as injection, the swivel 30 is preferably located directly adjacent the connecting rod 21.

The downhole swivel arrangement 30 in accordance with the invention is installed in a rotary downhole pumping system by the following procedure. The pump rotor 14, the drive rod(s) 23 connecting the quill 34 to the rotor and the swivel 30 are run into the well together with the stator 12 and the tubing 16. The tubing is filled frequently with liquid to prevent an unbalanced hydrostatic pressure from building up underneath the pump which would tend to push the rotor up and place excessive strain on the connecting rod(s) 21 between the rotor and the quill. When the tubing 16 is in place, the sucker rod string 22 is run into the well and its length adjusted with short rods (pony rods) to the exact length required to extend from the drive head 18 to the quill 34 of the swivel 30. Hollow shaft drive heads (Kudu Industries Inc., Calgary, Canada) can be used for small adjustments in rod string position. The drive rod string 22 is then attached to the quill 34 either by screwing it onto the fluid cross-over located towards the wellhead or by using an "on-off" connection well known in the art.

The advantages of the downhole swivel arrangement in accordance with the invention, especially when used in fluid pumping operations to support the hydrostatic load of the pumped liquid, will become apparent from the following calculation of the forces involved in a typical horizontal well fluid production scenario. For a well having a curved well bore with a 500 ft radius, the rod/tubing side loading force at the rod connections of a rod string made with standard 30 ft rods would exceed 500 pounds. If the standard rods were replaced with 6 ft pony rods with centralizers at each connection around the bend in the bore, the side loading on the centralizers will exceed 100 pounds in places. This causes excessive centralizer wear and reduced centralizer life. The situation becomes even worse for a 400 ft radius. However, if the hydrostatic load is taken off the rod string by way of a swivel arrangement in accordance with the invention, 30 ft standard sucker rods can be used around the bend with the side loading at the rod connections remaining below 100 pounds. Thus, the rod string connection can be kept out of contact with the tubing with centralizers which will not be overloaded.

Although the preferred swivel arrangement described above was discussed in the context of a curved well bore scenario, it will be readily apparent that swivel arrangements in accordance with the invention can be advantageously used in straight, vertical wells.

Changes and modifications in the specifically described embodiments can be carried out without departing from the scope of the invention which is intended to be limited only by the scope of the appended claims.

The embodiments of the invention in which an exclusive property or privilege is claimed are defined as follows:

1. A downhole apparatus for use in a downhole rotary pumping arrangement which includes a downhole rotary pump having a pump rotor attached to and operated by a pump drive string rotatable in a production tubing and suspended from a drivehead, the apparatus being used for supporting on the production robing at least part of an axial load on the pump drive string, comprising:

a support for rotatably supporting the drive string in the production tubing at a location between the pump rotor and the drivehead, the support including an axial load bearing means for rotatably supporting, on the production tubing, at least part of an axial load on the drive string caused by an axial load on the pump rotor; and a fluid passage for permitting the pumped liquid to flow from the pump past the axial load bearing means and to a wellhead of the well.

2. A downhole apparatus as defined in claim 1 for reducing, in a well having at least one curved section, the friction between the drive string and the production tubing of the pump, wherein the support for rotatably supporting the drive string in the production tubing is shaped and constructed to be installed at a location between the curved section of the well bore and the pump, the axial load bearing means being adapted to rotatably support, from the production tubing, at least part of the tensile load on the drive string generated by the hydrostatic load of a pumped liquid on the pump rotor and at least part of the weight of the drive string.

3. The apparatus of claim 2, wherein the axial load bearing means supports the tensile load on the drive string generated by the hydrostatic load of the pumped liquid on the pump rotor, and at least part of the weight of the drive string.

4. The apparatus of claim 3, wherein the support has a cylindrical housing for connection to the production tubing and a hollow shaft for connection to the drive string, the hollow shaft being axially rotatably supported in the housing by a pair of radial bearings, and the load bearing means includes an annular bearing seat on and radially inwardly protruding from the housing, an opposingly positioned radially inwardly protruding load bearing flange on the shaft, and a thrust bearing positioned therebetween.

5. A downhole apparatus as defined in claim 1, wherein the support for rotatably supporting the drive string in the production tubing is shaped and constructed to be installed at a location adjacent the pump, and the axial load bearing means is adapted to rotatably support on the production tubing at least part of an axial thrust load on the drive string caused by backpressure of injected fluid on the pump rotor during pressurized fluid injection into the well.

6. The apparatus of claim 5, wherein the support has a cylindrical housing for connection to the production tubing and a hollow shaft for connection to the drive string, the hollow shaft being axially rotatably supported in the housing by a pair of radial bearings, and the load bearing means includes first and second thrust bearings respectively mounted between an annular bearing seat on and radially inwardly protruding from the housing and an opposingly positioned radially outwardly protruding load bearing flange on the shaft, the first thrust bearing being shaped and constructed to support axial thrust loads on the pump drive string and the second thrust bearing being shaped and constructed to support axial tension loads on the pump drive string.

7. The apparatus of claim 6, wherein the radial bearings are needle bearings and the first and second thrust bearings are a spherical roller thrust bearings.

8. The apparatus of claim 1, wherein the support has a cylindrical housing for connection to the production tubing and a hollow shaft for connection to the drive string, the hollow shaft being axially rotatably supported in the housing by a pair of radial bearings, and the fluid passage is provided by the interior of the hollow shaft and by a pair of fluid cross-over means for respectively connecting, at an end of the hollow shaft, the interior of the hollow shaft with an adjacent annular space between the tubing and the drive string.

9. The apparatus of claim 8, wherein each cross-over means is a cross-over member having an axis and including a solid shaft having an enlarged end, connecting means for coaxially attaching the enlarged end to one of the ends of the inner hollow shaft, an axial bore in the enlarged end, and at least one radial bore in the shaft and located behind the connecting means and communicating with the axial bore.

10. The apparatus of claim 9, wherein the radial bore is an oblique radial bore which encloses an acute angle with the axis of the cross-over member.

11. The apparatus of claim 10, wherein the cross-over member includes four oblique radial bores which are evenly distributed about the axis of the cross-over member and penetrate an outer surface of the member behind the enlarged portion.

12. The apparatus of claim 11, wherein the connecting means are shaped and constructed for releasable attachment of the enlarged end to one of the ends of the hollow shaft.

13. The apparatus of claim 5, wherein the radial bearings are friction bearings provided by opposing surfaces of the hollow shaft and bearing sleeves coaxially positioned in the housing, the opposing surfaces being provided with surface layers of respectively dissimilar metals selected for reducing friction and wear therebetween.

14. A fluid cross-over for providing fluid communication between an interior of a hollow shaft and an annular space surrounding the shaft and the cross-over, comprising a solid shaft having an axis and an enlarged end, attachment means for coaxially connecting the enlarged end to an end of the hollow shaft, an axial bore in the enlarged end, and at least two radial bores in the shaft for connecting the axial bore with the annular space, the radial bores being evenly spaced about the axis and penetrating an outer surface of the cross-over behind the enlarged end, the diameter of the radial bores being selected such that the torsional strength of the cross-over at the radial bores is at least equal to the torsional strength in the remainder of the cross-over.

15. A fluid cross-over as defined in claim 14, wherein the radial bores are oblique radial bores and the number and axial diameter of the bores is selected such that the sum of the cross-sectional areas of the bores is at least equal the cross-sectional area of the axial bore.

16. A fluid cross-over as defined in claim 14, wherein at any point through the radial bores the total cross-sectional area of the material of the cross-over is at least equal to the corresponding cross-sectional area at any other point of the cross-over.

17. A fluid cross-over for use in a downhole apparatus as defined in claim 8, comprising a solid shaft having an axis and an enlarged end, attachment means for coaxially connecting the enlarged end to an end of the hollow shaft, an axial bore in the enlarged end, and at least two radial bores in the shaft for connecting the axial bore with the annular space, the radial bores being evenly spaced about the axis and penetrating an outer surface of the cross-over behind the enlarged end, the diameter of the radial bores being selected such that the torsional strength of the cross-over at the radial bores is at least equal to the torsional strength in the remainder of the cross-over.

* * * * *

UNITED STATES PATENT AND TRADEMARK OFFICE

CERTIFICATE OF CORRECTION

PATENT NO. : 5,697,768

DATED : December 16, 1997

INVENTOR(S) : Robert A. R. Mills

It is certified that error appears in the above-identified patent and that said Letters Patent is hereby corrected as shown below:

ON THE TITLE PAGE:

Item [73] Assignee: Kudu Industries, Inc., Canada

Column 8, line 51, delete "robing" and insert --tubing--

Signed and Sealed this

Twentieth Day of April, 1999

*Attest:*

Q. TODD DICKINSON

*Attesting Officer*

*Acting Commissioner of Patents and Trademarks*